United States Patent [19]

Dineen et al.

[11] Patent Number: 5,070,791

[45] Date of Patent: Dec. 10, 1991

[54] PROJECTILE TAIL CONE

[75] Inventors: John J. Dineen, Wharton; Winfred T. Watson, Flanders; Gary Fleming, Budd Lake, all of N.J.

[73] Assignee: The United States of America as represented by the Secretary of the Army, Washington, D.C.

[21] Appl. No.: 620,998

[22] Filed: Nov. 30, 1990

[51] Int. Cl.[5] ..... F42B 10/26

[52] U.S. Cl. ..... 102/517; 244/3.23

[58] Field of Search ..... 102/517, 518, 519; 244/3.23, 3.3

[56] References Cited

U.S. PATENT DOCUMENTS

| | | | |
|---|---|---|---|
| 34,285 | 1/1862 | Mefford | 244/3.23 |
| 279,964 | 6/1883 | Mefford | 244/3.23 |
| 1,794,141 | 2/1931 | Bloch-Jorgensen | 102/517 |
| 4,379,531 | 4/1983 | Manis | 244/3.23 |

FOREIGN PATENT DOCUMENTS

| | | | |
|---|---|---|---|
| 409421 | 2/1945 | Italy | 244/3.23 |

*Primary Examiner*—Michael J. Carone

*Attorney, Agent, or Firm*—Anthony T. Lane; Edward Goldberg; Michael C. Sachs

[57] ABSTRACT

A projectile for use as a range limiting type of projectile is provided. The projectile is used with a selective cartridge in a smooth bore gun. This projectile has a body member and a connecting tail cone, which provides projectile roll and which provides velocity decay and high drag to limit projectile range. The tail cone has a conical outer surface which has a plurality of canted grooves.

1 Claim, 1 Drawing Sheet

PROJECTILE TAIL CONE

GOVERNMENTAL INTEREST

The invention described herein may be manufactured, used and licensed by and for the Government for governmental purposes without the payment to us of any royalties thereon.

FIELD OF THE INVENTION

The invention generally relates to a projectile tail cone, and in particular the invention relates to a projectile tail cone of conical shape having canted grooves.

BACKGROUND OF THE INVENTION

The prior art projectile includes a steel body member, and a steel cone, the body member having an axis and an exterior surface and a forward surface and a rearward side, and the tail cone having a front face connected to the rearward side and having an outer surface with a conical shape and an inner surface with a conical shape and a plurality of holes extending between the conical surfaces and being peripherially spaced.

The prior art projectile, which has a body member and a tail cone, is used with a selective cartridge in a smooth bore gun. The projectile, which is a range limiting type of projectile, has a cone with a plurality of holes for producing a projectile roll during flight, and for producing a choking off of the air stream as the velocity decays causing a high drag effect on the projectile to limit projectile range.

One problem with the prior art projectile is that the choking off of the air stream does not act uniformly at each of the holes, and the rate of velocity decay is variable, so that the vertical impact height on the target, as required, is adversely affected, and also impact dispersion is adversely affected. In addition, the mass of the steel tail cone causes the projectile to be marginally statically stable. Static stability is proportional to the separation between the projectile's center of gravity and its center of air stream pressure. Thus, a rearward center of gravity would reduce the static stability margin of the projectile.

SUMMARY OF THE INVENTION

According to the present invention, a projectile having a body member and a tail cone is provided. The projectile comprises, a steel body member and an aluminum tail cone, the body member having an axis and a peripheral, exterior surface swept in flight by an air stream and having a forward surface and a rearward side, and the tail cone having a front face connected to the rearward side and having an outer surface with a conical shape and an inner surface with a conical shape, said conical outer surface having a plurality of canted grooves being equally spaced in a peripheral direction, each said groove having a windward sidewall and a leeward sidewall and a bottom wall.

By using the plurality of canted grooves in the conical outer surface, the non-uniformity of choking off of the air stream is eliminated, and the variability of projectile velocity decay is minimized, whereby the required vertical impact height and impact dispersion is improved. By using an aluminum tail cone, the projectile's center of gravity is shifted forward towards the nose of the projectile. The increased separation between the projectile's center of gravity and center of pressure increases the static stability margin of the projectile.

Enhancing the stability characteristics of the projectile improves the projectile impact dispersion through improved launch characteristics.

The foregoing and other objects, features and advantages will be apparent from the following description of the preferred embodiment of the invention as illustrated in the accompanying drawings.

DESCRIPTION OF THE PREFERRED EMBODIMENT

Figure 1:
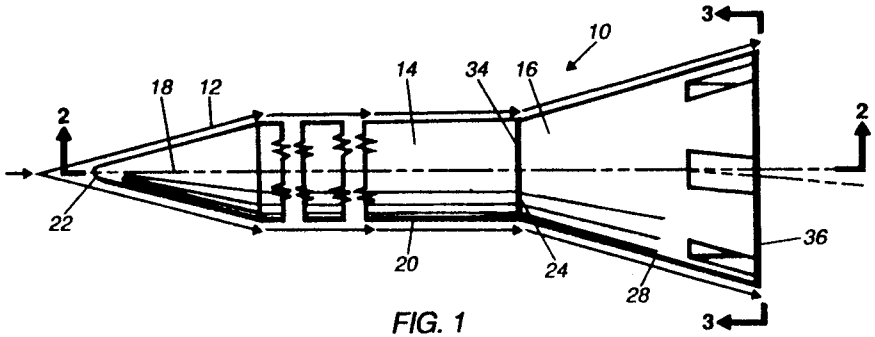
FIG. 1 is an elevation view of a projectile according to the present invention.
Figure 2:
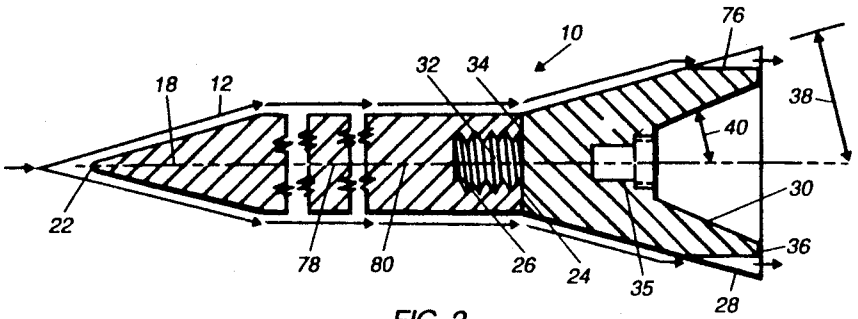
FIG. 2 is a section view as taken along line 2—2 of FIG. 1.

As shown in FIGS. 1 and 2, a sub-projectile or projectile 10 is provided. Projectile 10 is swept in flight by an air stream 12. Projectile 10 has a body member 14 and a tail cone 16 which have a common axis 18.

Body 14 has an exterior surface 20, a forward surface 22, and a rearward side 24, which has a threaded recess 26.

Tail cone 16 has a conical outer surface 28, which is about flush with exterior surface 20, and has a conical inner surface 30. Tail cone 16 has a threaded projection 32, which is received by recess 26. Tail cone 16 has a front bearing face 34, which bears against rearward side 24. Tail cone 16 also has a rear face 36 of annular shape. Tail cone 16 also has a rear cylindrical threaded recess 35.

Outer surface 28 has a slope angle 38 of about 15 degrees, in a plane including axis 18. Inner surface 30 has a slope angle 40 of about 22 degrees. Outer surface 28 has six canted, or slightly helically shaped, grooves 42, 44, 46, 48, 50, 52, which are equally spaced in a peripheral direction, and which form therebetween six canted radial projections or blades 54, 56, 58, 60, 62, 64.

Figure 3:
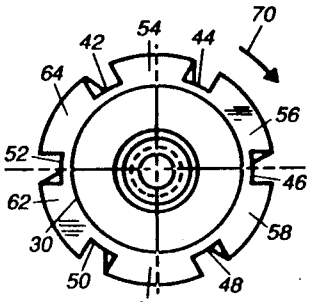
FIG. 3 is an elevation view as taken along line 3—3 of FIG. 1.

Typical groove 42 is identical to groves 44, 46, 48, 50, 52. Groove 42 has a windward sidewall 66 and has a leeward sidewall 68. Air stream 12 causes a slightly higher pressure in flight on windward sidewall 66 than on leeward sidewall 68, thereby causing a rotation of projectile 10 in a clockwise direction 70, as viewed in FIG. 3.

Figure 4:
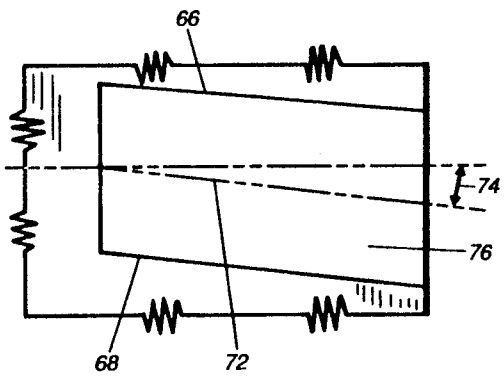
FIG. 4 is an enlarged view of a portion of FIG. 1.

As shown in FIG. 4, typical groove 42 has a reference groove centerline 72, which is equidistant from groove sidewalls 66 and 68, and which has a cant angle 74 of about one degree. Groove 42 also has a bottom wall 76, which is about parallel to axis 18, as shown in FIG. 2.

Projectile 10 has a center of pressure 80 and a center of gravity 78. The smaller the distance between the center of pressure 80 and the center of gravity 78, the lower is the static stability of a projectile. By using a tail cone 16, composed of aluminum instead of steel, the center of gravity is shifted forward towards the nose of the projectile. This increases the separation between the center of gravity and center of pressure thereby increasing the static stability of the projectile.

The process of manufacturing projectile 10 includes the steps of:

forming a steel body member 14 having a forward surface 22 and peripheral exterior surface 20 and a rearward side 24;

forming an aluminum tail cone 16 having a front face 34 connected to the rearward side 24 and having a conical outer surface 28 and having a conical inner surface 30;

forming a plurality of canted grooves 42, 44, 46, 48, 50, 52 in the conical outer surface 28 with each groove having a windward sidewall 66 and a leeward sidewall 68 and a bottom wall 76.

The advantages of projectile 10 and tail cone 16 are indicated hereafter.

A) The variability in velocity decay is eliminated using canted grooves 42, 44, 46, 48, 50, 52, so that the desired vertical impact height and impact dispersion of projectile 10 is improved.

B) By using a tail cone 16, which is composed of aluminum instead of steel, the static stability margin of the projectile 10 is increased.

C) The cost of manufacture of canted grooves 42, 44, 46, 48, 50, 52 of projectile 10 is substantially less than the cost of manufacture of the plurality of holes in the tail cone of the prior art projectile.

D) Performance data of projectile 10 with a range limiting, slotted, aluminum tail cone 16 is better than the corresponding performance data of the prior art projectile.

While the invention has been described in its preferred embodiment, it is to be understood that the words which have been used are words of description rather than limitation and that changes may be made within the purview of the appended claims without departing from the free scope and spirit of the invention in its broader aspects.

The embodiments of an invention in which an exclusive property or right is claimed are defined as follows:

1. A projectile comprising:

a body member;

a tail cone;

said body member having an axis, a peripheral exterior surface which is swept in flight by an air stream, a forward surface, and a rearward side;

said tail cone having a front face connected to the rearward side and having a conical outer surface which is swept by the air stream, and having a conical inner surface, said conical inner surface having a slope angle relative to the said axis in a plane through the axis of about 22 degrees and said conical outer surface having a slope angle relative to the axis in a plane through the said axis of about 15 degrees;

said conical outer surface having a plurality of canted grooves being equally spaced in a peripheral direction, said grooves each having a center-line which has a cant angle of about one degree relative to a plane through the said axis, a windward sidewall, a leeward sidewall, and a bottom wall, wherein the bottom wall of each groove is disposed in a plane about parallel to the said axis.

* * * * *